US007040511B1

(12) United States Patent
Petit

(10) Patent No.: US 7,040,511 B1
(45) Date of Patent: May 9, 2006

(54) PUMP FOR DISPENSING FLUID PRODUCT, AND FLUID PRODUCT DISPENSING DEVICE COMPRISING SAME

(75) Inventor: Ludovic Petit, Vitot (FR)

(73) Assignee: Valois S.A., Le Neubourg (FR)

( * ) Notice: Subject to any disclaimer, the term of this patent is extended or adjusted under 35 U.S.C. 154(b) by 81 days.

(21) Appl. No.: 10/070,641

(22) PCT Filed: Sep. 7, 2000

(86) PCT No.: PCT/FR00/02475

§ 371 (c)(1),
(2), (4) Date: Aug. 19, 2002

(87) PCT Pub. No.: WO01/17690

PCT Pub. Date: Mar. 15, 2001

(30) Foreign Application Priority Data

Sep. 9, 1999 (FR) ..... 99 11262

(51) Int. Cl.
*B67D 5/58* (2006.01)

(52) U.S. Cl. ..... 222/189.09; 222/321.2; 222/321.89

(58) Field of Classification Search ..... 222/189.09, 222/189.11, 321.2, 321.7, 321.9
See application file for complete search history.

(56) References Cited

U.S. PATENT DOCUMENTS 4,694,976 A * 9/1987 Schuetz ..... 222/189.11
5,927,559 A * 7/1999 Bommer et al. ..... 222/189.09
5,988,449 A * 11/1999 Fuchs et al. ..... 222/189.11
6,053,368 A * 4/2000 Geimer ..... 222/189.09

* cited by examiner

*Primary Examiner*—Joseph A. Kaufman
(74) *Attorney, Agent, or Firm*—Sughrue Mion, PLLC

(57) ABSTRACT

A fluid dispenser pump including a pump body (10), a piston (20) being slidably received in leaktight manner in the pump body (10) to slide between a rest position and a dispensing position, the top edge (11) of the pump body (10) being fixed in a fixing ring (5) serving to assemble the pump to a reservoir (1), an annular sealing gasket (100, 200) being disposed between the pump body (10) and the fixing ring (5), the pump further being provided with a intake air passageway (80) between the reservoir (1) and the atmosphere, the pump being characterized in that a filtration and/or treatment element (100) for filtering and/or treating the intake air is provided in the intake air passageway (80), the filtration element (100) being disposed between the top edge (11) of the pump body and the fixing ring (5).

32 Claims, 6 Drawing Sheets

PUMP FOR DISPENSING FLUID PRODUCT, AND FLUID PRODUCT DISPENSING DEVICE COMPRISING SAME

FIELD OF THE INVENTION

The present invention relates to an improved fluid dispenser pump, and to a fluid dispenser device including such a pump. More particularly, the present invention relates to a fluid dispenser pump incorporating filtration and/or treatment means for filtering and/or treating intake air.

BACKGROUND OF THE INVENTION

In numerous uses, in particular for pharmaceutical uses, it is desirable to avoid incorporating preservatives in the fluid to be dispensed. To achieve that, there are two possible solutions. The first solution consists in using an airless system, i.e. a system which does not draw in any air. In which case, a fluid reservoir is provided whose volume decreases each time fluid is dispensed so as to compensate for the suction generated by a determined quantity of fluid being expelled. For example, this may be achieved by means of a flexible pouch that is emptied progressively, or by means of a follower piston disposed in the reservoir. The second solution is to treat or to filter the air drawn in each time fluid is dispensed. For this purpose, filtration elements are advantageously disposed in the intake air passageway in the dispenser pump or in the dispenser device. Thus, Document EP-0 189 549 discloses disposing a filter against the vertical side wall of the pump body that incorporates a vent hole. Document EP-0 800 869 discloses disposing a filter on the top edge of the neck of the receptacle. Document WO 97/18902 discloses disposing a filter inside the pump body between the piston and said pump body.

The systems described above suffer from the major drawback of being complicated to implement. It is necessary to modify at least one component part of the pump or of the dispenser device incorporating said pump, and assembly is therefore made more complex. The manufacturing and assembly cost is thus increased.

SUMMARY OF THE INVENTION

An object of the present invention is to provide a fluid dispenser pump and a fluid dispenser device including such a pump that do not reproduce the above-mentioned drawbacks.

An object of the present invention is to provide such a fluid dispenser pump and such a fluid dispenser device including such a pump that make it possible to filter and/or to treat the intake air simply and reliably without having to modify any component part of the fluid dispenser pump or of the fluid dispenser device.

Another object of the present invention is to provide such a fluid dispenser pump and such a fluid dispenser device incorporating such a pump in which the system for filtering the intake air is simpler and less costly to implement, in particular industrially.

The present invention thus provides a fluid dispenser pump including a pump body, a piston being slidably received in leaktight manner in said pump body to slide between a rest position and a dispensing position, the top edge of the pump body being fixed in a fixing ring serving to assemble said pump to a reservoir, an annular sealing gasket being disposed between said pump body and said fixing ring, said pump further being provided with a intake air passageway between the reservoir and the atmosphere, said pump being characterized in that a filtration and/or treatment element for filtering and/or treating the intake air is provided in said intake air passageway, said filtration element being disposed between said top edge of the pump body and said fixing ring.

In a first variant embodiment, said intake air passageway is open when the pump is in all of its positions.

Preferably, said annular gasket forms the filtration element, said gasket being permeable to air and impermeable to the fluid dispensed by said pump.

In another embodiment, the pump further includes a ferrule mounted on the top edge of the pump body between said top edge and said annular gasket, said ferrule extending inside said pump body to co-operate with said piston when said piston is in the rest position, the filtration element being disposed between the top edge of the pump body and said ferrule.

Advantageously, the top edge of the pump body is provided with a through bore defining a portion of the intake air passageway, said filtration element being disposed between said top edge of the pump body and said ferrule, while covering over said through bore completely.

Advantageously, said filtration element is provided with passageway means for defining a portion of air passageway between the ferrule and the annular gasket.

In a second variant embodiment, said intake air passageway is defined between the ferrule and said pump body so that the ferrule closes off said air passageway when the pump is in the rest position, said air passageway being open when said piston is displaced towards its dispensing position.

Advantageously, said ferrule is provided with a radial flange co-operating with the top edge of the pump body, said flange incorporating an opening and/or passageway means, such as one or more grooves and/or ribs to define a portion of intake air passageway.

Advantageously, said top edge of the pump body is provided with passageway means such as one or more grooves and/or ribs to define a portion of intake air passageway.

Advantageously, said filtration element is disposed on the end wall of said top edge of the pump body, between said passageway means in said flange and said passageway means in said pump body.

In an advantageous variant embodiment, the pump includes a ferrule mounted on the top edge of the pump body between said top edge and said annular gasket, said ferrule extending inside said pump body to co-operate with said piston when said piston is in the rest position, the filtration element being disposed between said ferrule and said fixing ring.

Advantageously, the pump body incorporates a vent hole forming a portion of the intake passageway defined between the ferrule and the pump body.

The present invention also provides a fluid dispenser device including such a dispenser pump as defined above.

BRIEF DESCRIPTION OF THE DRAWINGS

The advantages and characteristics of the present invention will appear more clearly on reading the following detailed description of embodiments of the invention given by way of non-limiting example and with reference to the accompanying drawings, in which.

DETAILED DESCRIPTION OF THE INVENTION

Figure 2:
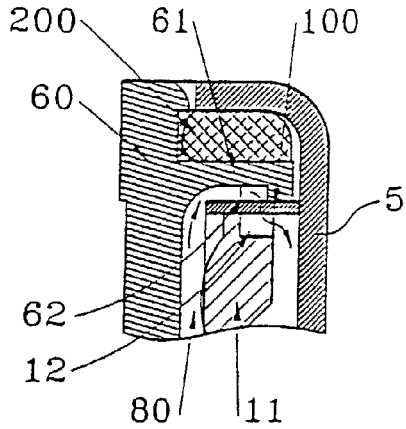
FIG. 2 is an enlarged diagrammatic view of a detail of FIG. 1.

With reference to the figures, the fluid dispenser pump includes a pump body 10 slidably receiving a piston 20 in leaktight manner. The piston is advantageously connected to an actuating rod 21. The pump body 10 is generally assembled to the neck of a reservoir 1 by means of a fixing ring 5, which may be of any type, and in particular snap-fastenable, screw-on, or crimp-on. The sealing between the pump and the fixing ring 5 is provided by means of an annular gasket 100, 200, and the sealing between the fixing ring 5 and the reservoir 1 is provided by means of a neck gasket 300.

Inside the pump body 10, a pump chamber 30 is defined between an inlet valve 40, 41 and an outlet valve 50, 51, so that the pump shown in the figures is a pre-compression pump. When the user actuates a dispensing head (not shown), said dispensing head co-operates with the actuating rod 21 to displace the piston 20 in leaktight manner inside the pump body 10. This displacement causes the inlet valve 40 to close, so that the volume of fluid is defined inside the pump chamber 30. Then, the outlet valve 50 is caused to open by the pressure generated inside the pump chamber 30, so that said metered quantity of fluid is expelled through the expulsion channel 6.

To avoid generating suction inside the reservoir, the pump of the invention is provided with a intake air passageway 80 connecting the inside of the reservoir to the atmosphere. In a first variant embodiment shown in FIGS. 3 to 5, the intake air passageway 80 is open when the pump is in all of its positions. It advantageously extends between the top edge 11 of the pump body 10 and the fixing ring 5.

In a preferred embodiment of the invention, shown in FIGS. 5, 6, 7, and 9, the annular gasket 100 forms a filtration and/or treatment element for filtering and/or treating the intake air. In which case, it is impermeable to the fluid contained in the reservoir, but permeable to air, while having a filtering action on the incoming air. This makes it possible to omit one part, namely the filter, thereby simplifying manufacture and assembly and reducing cost.

Figure 4:
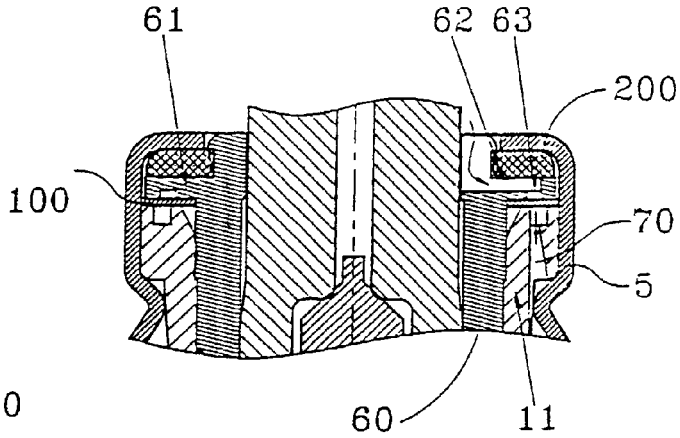
FIG. 4 is an enlarged diagrammatic view of a detail of FIG. 3.
Figure 3:
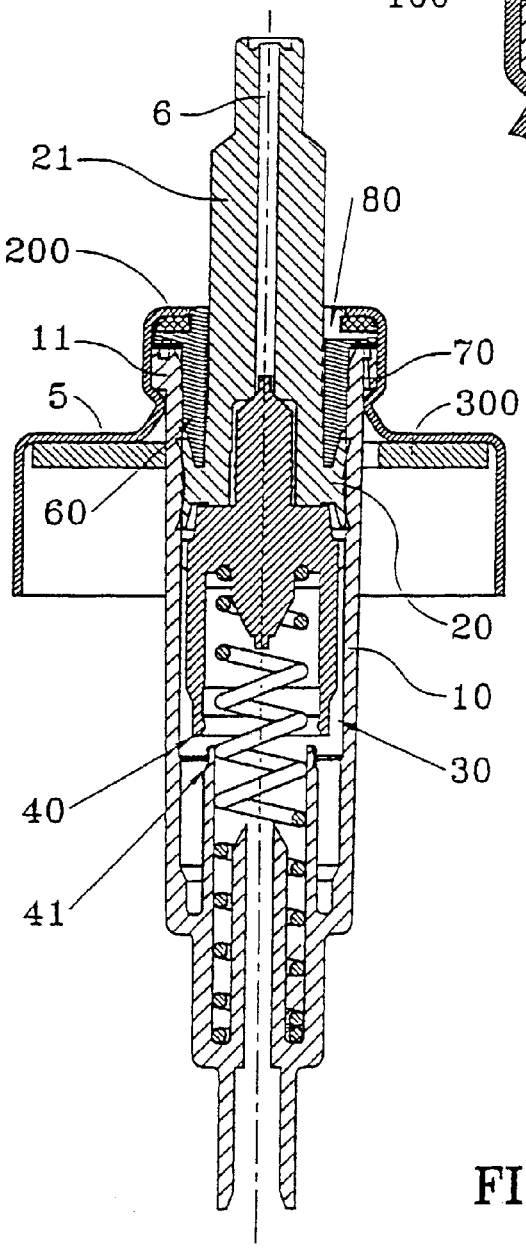
FIG. 3 is a diagrammatic view similar to FIG. 1, showing a second variant embodiment of the invention.

In another advantageous embodiment shown in FIGS. 3 and 4, the filtration element 100 is distinct from the gasket 200, and is disposed between the top edge 11 of the pump body 10, and a ferrule 60. The ferrule 60 is itself disposed between the top edge 11 of the pump body 10 and the fixing ring 5, with the sealing gasket 200 being interposed. The ferrule 60 extends inside the pump body 10 to co-operate with the piston 20 and to define the rest position therefor. Advantageously, the ferrule 60 is provided with a radial flange 61 which rests on the end wall of the top edge 11 of the pump body, with the filtration element being interposed.

Advantageously, the air passageway 80 may be defined by a through bore 70 provided in the top edge 11 of the pump body 10. The filtration element 100 is then preferably disposed between said top edge 11 of the pump body 10 and said ferrule 60, while completely covering over said bore 70. Optionally, said filtration element 100 may be provided with passageway means for defining an air passageway portion between the ferrule 60 and the annular gasket 200 providing the sealing between the pump and the fixing ring 5. In a variant, it is the ferrule 60 that can incorporate passageway means for defining an air passageway portion. In which case, the passageway means may comprise an opening 63 provided in the radial flange 61 of the ferrule 60. In addition, ribs and/or grooves 62 may be provided in the radial flange, on that one of its sides which is in contact with the gasket 200.

Figure 1:
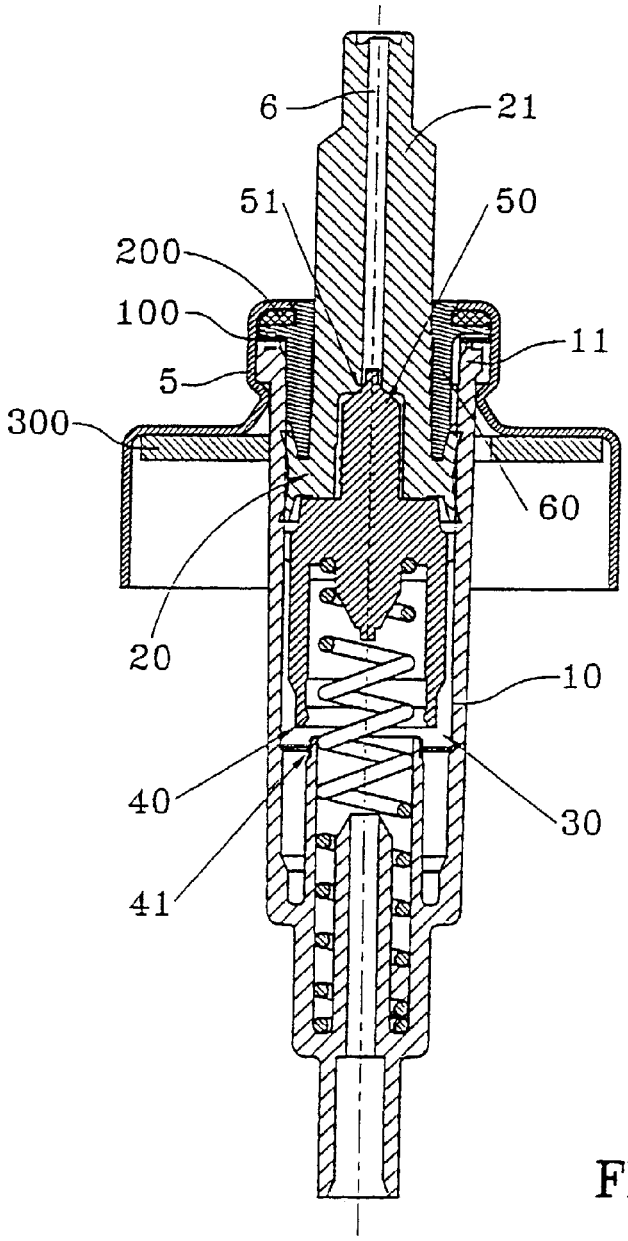
FIG. 1 is a diagrammatic section view of a fluid dispenser pump in a first variant embodiment of the present invention.

In a second variant embodiment shown in FIGS. 1 and 2, the intake air passageway 80 is not open when the pump is in all of its positions. When the pump is in the rest position, as shown in FIG. 1, said ferrule defines the rest position of the piston by forming an abutment against which the piston 20 is displaced axially, and said ferrule 60 also co-operates in leaktight manner with said piston to close off said intake air passageway 80. This intake air passageway extends firstly between the actuating rod 21 and the top end of the ferrule 60. It goes down the inside wall of the ferrule 60 to the bottom end thereof, where it is closed off by the piston 20 when said piston is in the rest position. When the piston 20 is displaced towards its dispensing position when the pump is actuated, the intake air passageway 80 is open at that place and it is extended between the pump body 10 and the outside of the ferrule 60 to the level of the top edge 11 of the pump body 10. Then, it goes between the outside of the pump body 10 and the fixing ring 5, and it penetrates into the reservoir (not shown in FIG. 1).

In this variant, the filtration and/or treatment element for filtering and treating the intake air 100 is also disposed between the top edge 11 of the pump body 10 and said ferrule 60. In FIG. 2, the arrows diagrammatically show the flow of intake air at that place. Preferably, the filtration element 100 is permeable to air, but impermeable to the fluid contained in the reservoir and/or in the pump.

The radial flange 61 of the ferrule 60 is preferably provided with passageway means 62 such as one or more grooves and/or ribs to define a intake air passageway. Similarly, the top edge 11 of the pump body 10 may also be provided with passageway means 12, such as one or more grooves and/or ribs to define an air passageway. Thus, in the example shown in FIG. 2, the filtration element 100 is interposed between said passageway means 12 in the pump body 10 and said passageway means 62 in the ferrule 60.

The filtration element 100, which may be made in the form of a radial annular element, is very easy to make and simple to assembly, without requiring any major modification of any component part of the pump. In the particular example shown in FIGS. 1 to 4, the filtration ring 100 is merely laid on the top edge 11 of the pump body before the ferrule 60 is put in place. The passageway means 62, 12, or 102 respectively in the ferrule 60, in the pump body 10, and in the filtration element are very simple and inexpensive to make, and it is clear that any suitable passageway means may be considered without going beyond the ambit of the present invention.

FIGS. 6 to 9 show various variant embodiments in which the intake passageway 80 extends firstly between the ferrule 60 and the fixing ring 5 and then between the ferrule 60 and the pump body 10. The pump body 10 is then provided with a vent hole 85 opening out in the reservoir. This embodiment makes it possible to make the neck gasket 300 completely leaktight on the pump body 10, and thus to prevent any risk of the fluid coming into contact with the intake passageway 80, the vent hole 85 being closed off by the piston 20 when the pump is in the rest position. Optionally, the neck gasket 300 may be provided with a valve 310 (shown in FIG. 9) to isolate the vent hole 85. In the variants of FIGS. 6 to 9, the ferrule 60 co-operates in leaktight manner with the actuating rod 21, e.g. by means of a sealing lip 65 provided on the inside surface of the ferrule 60.

Figure 5:
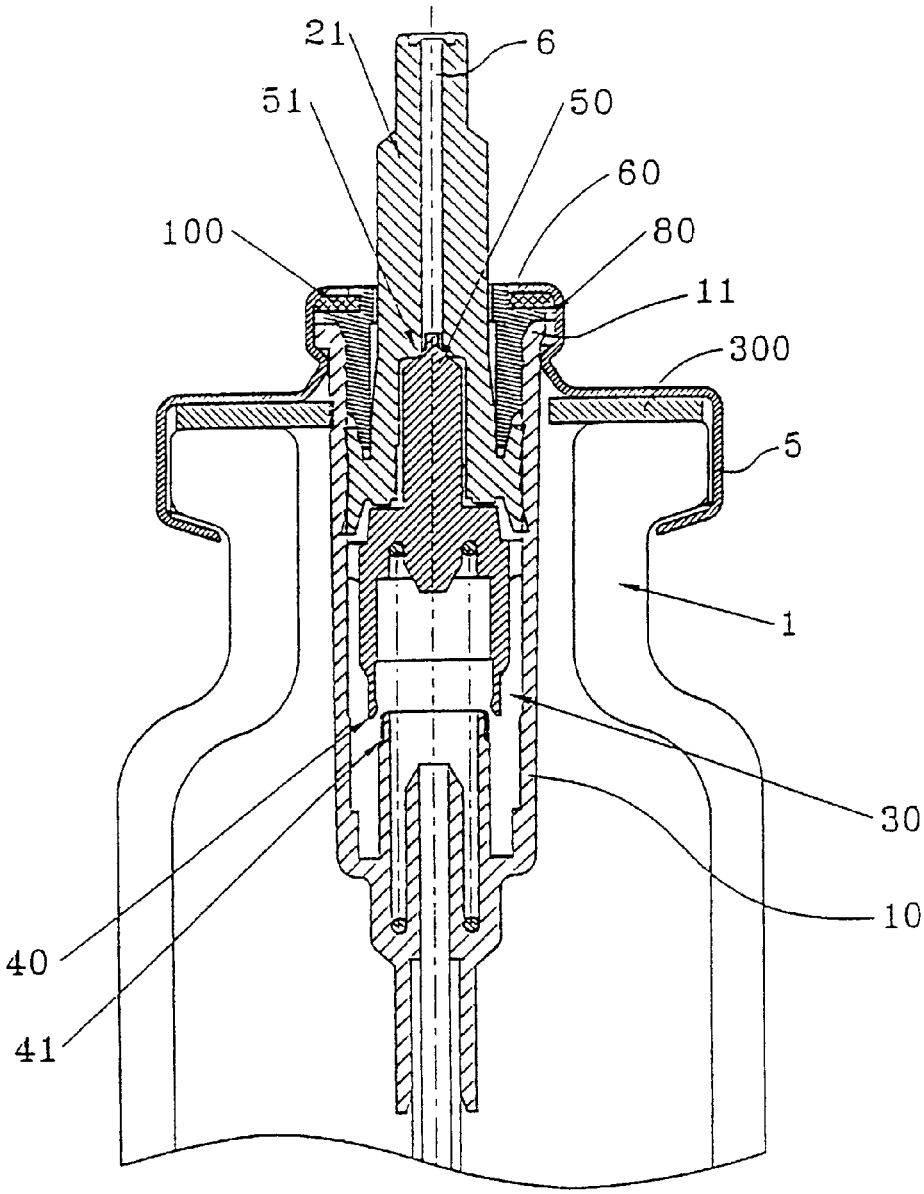
FIG. 5 is a diagrammatic section view of a dispenser device including a pump in a preferred embodiment of the invention.
Figure 7:
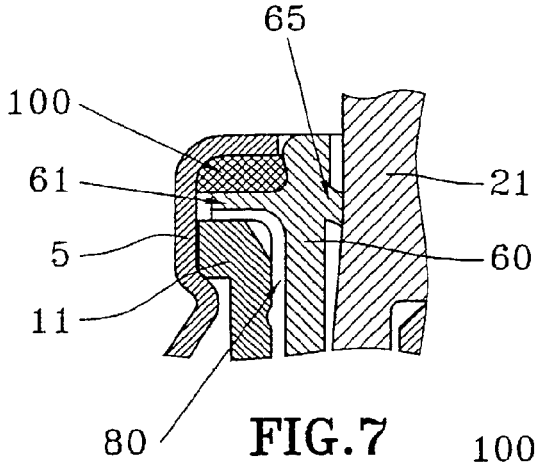
FIG. 7 is an enlarged diagrammatic view of a detail of FIG. 6.
Figure 6:
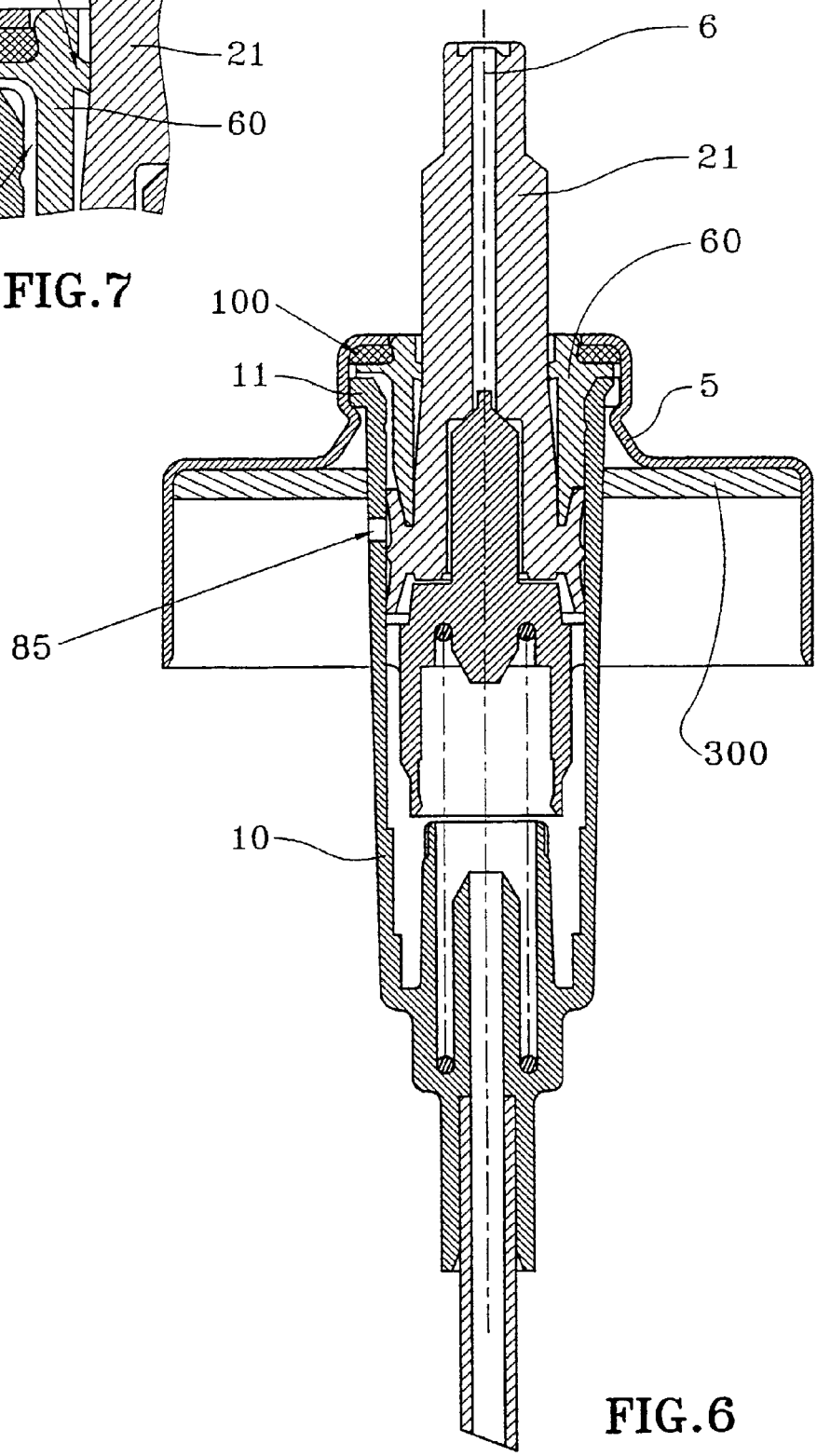
FIG. 6 is a diagrammatic view similar to FIGS. 1 and 3, showing a variant embodiment of the invention.
Figure 9:
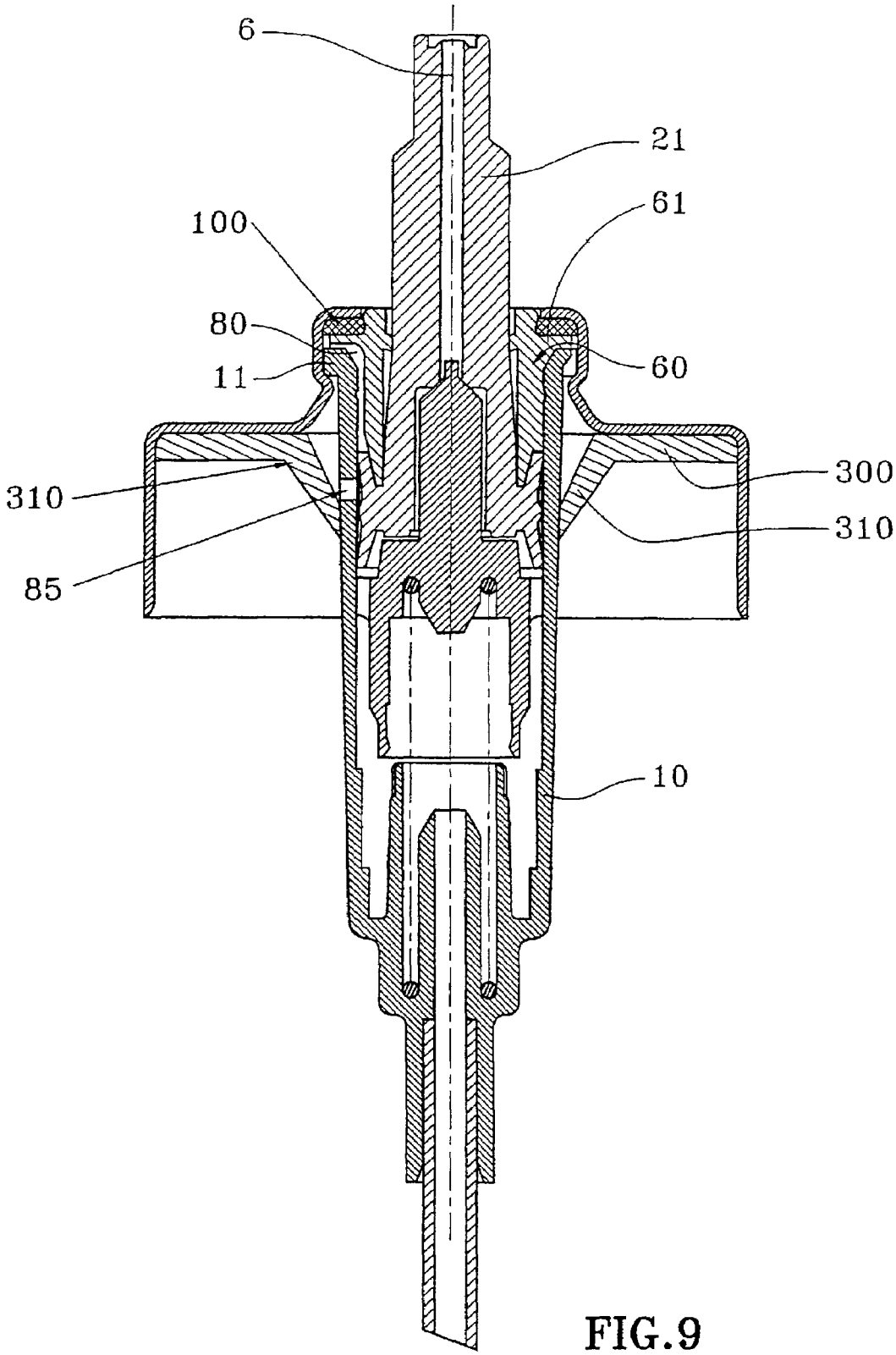
FIG. 9 is a diagrammatic view of yet another embodiment of the invention.

In the embodiment of FIGS. 6, 7, and 9, the gasket 100 forms the filter in a manner similar to the embodiment of FIG. 5. In these variants, it is disposed between the radial flange 61 of the ferrule 60 and the fixing ring 5.

Figure 8:
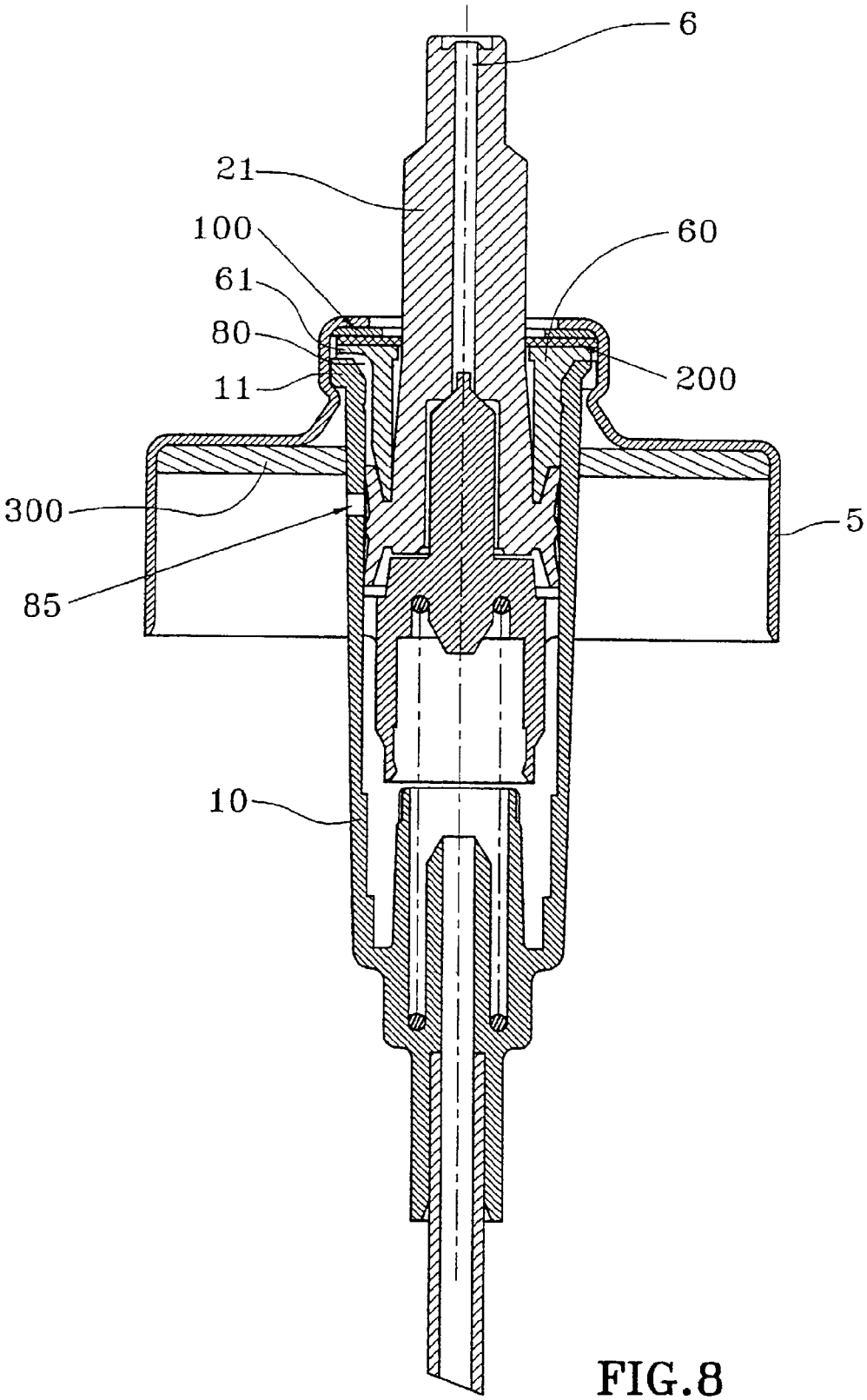
FIG. 8 is a diagrammatic view of another variant embodiment of the invention.

In the example of FIG. 8, the filter 100 is disposed on the gasket 200, these two elements being provided between the radial flange 61 of the ferrule 60 and the fixing ring 5. In particular, the filter 100 is disposed between the gasket 200 and the fixing ring.

The filtration element may be made of any suitable material adapted to filtering and/or to treating the intake air that penetrates into the reservoir and that is to come into contact with the fluid.

Although it is shown with reference to particular types of pump, the present invention is naturally applicable to any type of pump for dispensing a fluid. Other modifications may also be considered without going beyond the ambit of the present invention, the scope of which is defined by the accompanying claims.

The invention claimed is:

1. A fluid dispenser pump including a pump body (10), a piston (20) being slidably received in leaktight manner in said pump body (10) to slide between a rest position and a dispensing position, the top edge (11) of the pump body (10) being fixed in a fixing ring (5) to form a location of fixation between the top edge and the fixing ring and serving to assemble said pump to a reservoir (1), an annular sealing gasket (100, 200) being disposed between said pump body (10) and said fixing ring (5), said pump further being provided with a intake air passageway (80) between the reservoir (1) and the atmosphere, said pump being characterized in that a filtration element (100) that filters or treats the intake air is provided in said intake air passageway (80), said filtration element (100) being disposed between said top edge (11) of the pump body and said fixing ring (5) and above said top edge of the pump body and above the location of fixation between the top edge and the fixing ring.

2. A pump according to claim 1, in which said intake air passageway (80) is open when the pump (20) is in all of its positions.

3. A pump according to claim 1, in which said annular gasket (100) forms the filtration element, said gasket (100) being permeable to air and impermeable to the fluid dispensed by said pump.

4. A pump according to claim 1, in which the pump further includes a ferrule (60) mounted on the top edge (11) of the pump body (10) between said top edge and said annular gasket (200), said ferrule (60) extending inside said pump body (10) to co-operate with said piston (20) when said piston (20) is in the rest position, the filtration element (100) being disposed between the top edge (11) of the pump body (10) and said ferrule (60).

5. A pump according to claim 4, in which the top edge (11) of the pump body (10) is provided with a through bore (70) defining a portion of the intake air passageway (80), said filtration element (100) being disposed between said top edge (11) of the pump body (10) and said ferrule (60), while covering over said through bore (70) completely.

6. A pump according to claim 5, in which said filtration element (100) is provided with passageway means for defining a portion of the intake air passageway between the ferrule (60) and the annular gasket (200).

7. A pump according to claim 4, in which said intake air passageway (80) is defined between the ferrule (60) and said pump body (10) so that the ferrule (60) closes off said intake air passageway (80) when the pump is in the rest position, said intake air passageway (80) being open when said piston (20) is displaced towards its dispensing position.

8. A pump according to claim 4, in which said ferrule (60) is provided with a radial flange (61) co-operating with the top edge (11) of the pump body (10), said flange (61) incorporating an opening (63) or passageway means (62).

9. A pump according to claim 8, in which said top edge (11) of the pump body (10) is provided with passageway means (12), comprising one or more grooves or ribs to define a portion of the intake air passageway.

10. A pump according to claim 9, in which said filtration element (100) is disposed on the end wall of said top edge (11) of the pump body (10), between said passageway means (62) in said flange (61) and said passageway means (12) in said pump body (10).

11. A pump according to claim 8, wherein a groove or rib defines a portion of intake air passageway.

12. A pump according to claim 4, in which said ferrule (60) is provided with a radial flange (61) co-operating with the top edge (11) of the pump body (10), said flange (61) incorporating an opening (63) and passageway means (62).

13. A pump according to claim 12, wherein a groove or rib defines a portion of intake air passageway.

14. A pump according to claim 1, in which the pump includes a ferrule (60) mounted on the top edge (11) of the pump body (10) between said top edge and said annular gasket (200), said ferrule (60) extending inside said pump body (10) to co-operate with said piston (20), the filtration element (100) being disposed between said ferrule (60) and said fixing ring (5).

15. A pump according to claim 1, in which the pump body (10) incorporates a vent hole (85) forming a portion of the intake passageway (80) defined between the ferrule (60) and the pump body (10).

16. A fluid dispenser device characterized in that it includes a dispenser pump according to claim 1.

17. The pump according to claim 1, wherein the top edge of the pump body is the uppermost part of the pump body.

18. The pump according to claim 1, wherein the filter is located exterior to the pump body.

19. The pump according to claim 1, wherein the filter is located outside the pump body and above the top edge of the pump body.

20. The pump according to claim 1, wherein the filter extends radially beyond an outside wall of the pump body.

21. A fluid dispenser pump, comprising:

a pump, comprising a pump body and a piston slidably received in the pump body, the piston slides between a rest position and a dispensing position;

a reservoir;

a fixing ring that couples the pump to the reservoir, wherein a top edge of the pump body is fixed in the fixing ring to form a location of fixation between the top edge and the fixing ring;

a sealing gasket disposed between the pump body and the fixing ring; and an intake air passageway connecting the reservoir to the atmosphere; and an element that filters or treats the intake air provided in the intake air passageway, the element disposed between the top edge of the pump body and the fixing ring and above the top edge of the pump body and above the location of fixation between the top edge and the fixing ring.

22. The pump according to claim 21, wherein the element filters the intake air provided in the intake air passageway.

23. The pump according to claim 21, wherein the element treats the intake air provided in the intake air passageway.

24. The pump according to claim 21, wherein the intake air passageway is open when the pump is in any position between and including the rest position and the dispensing position.

25. The pump according to claim 21, wherein the gasket forms the element, the gasket being permeable to air and impermeable to the fluid dispensed by said pump.

26. The pump according to claim 21, wherein the pump includes a ferrule mounted on the top edge of the pump body between the top edge and the gasket, the ferrule extending inside the pump body to co-operate with the piston when the piston is in the rest position, the element disposed between the top edge of the pump body and the ferrule.

27. The pump according to claim 26, in which the top edge of the pump body is provided with a through bore defining a portion of the intake air passageway, the element disposed between the top edge of the pump body and the ferrule, while covering over said through bore completely.

28. The pump according to claim 27, in which the element is provided with passageway means for defining a portion of the intake air passageway between the ferrule and the annular gasket.

29. The pump according to claim 26, wherein the intake air passageway is defined between the ferrule and the pump body so that the ferrule closes off the intake air passageway when the pump is in the rest position, the intake air passageway being open when the piston is displaced towards its dispensing position.

30. The pump according to claim 26, in which said ferrule is provided with a radial flange co-operating with the top edge of the pump body, said flange incorporating an opening or passageway means.

31. The pump according to claim 21, in which the pump includes a ferrule mounted on the top edge of the pump body between said top edge and said annular gasket, the ferrule extending inside said pump body to co-operate with said piston, the element being disposed between the ferrule and the fixing ring.

32. The pump according to claim 21, in which the pump body incorporates a vent hole forming a portion of the intake passageway defined between the ferrule and the pump body.

* * * * *